US006447428B1

(12) United States Patent
McKillip

(10) Patent No.: US 6,447,428 B1
(45) Date of Patent: Sep. 10, 2002

(54) EXERCISE DEVICE

(75) Inventor: James Morris McKillip, Muleshoe, TX (US)

(73) Assignee: Motorcizer Corporation, Littlefield, TX (US)

( * ) Notice: Subject to any disclaimer, the term of this patent is extended or adjusted under 35 U.S.C. 154(b) by 0 days.

(21) Appl. No.: 09/706,473

(22) Filed: Nov. 3, 2000

Related U.S. Application Data

(60) Provisional application No. 60/164,244, filed on Nov. 8, 1999.

(51) Int. Cl.[7] ..... A63B 69/16

(52) U.S. Cl. ..... 482/57; 482/60; 482/62

(58) Field of Search ..... 482/130, 142, 482/96, 4, 907, 133, 79, 80, 124, 904, 52, 57, 148, 61, 62

(56) References Cited

U.S. PATENT DOCUMENTS

| | | | | | |
|---|---|---|---|---|---|
| 2,668,709 | A | | 2/1954 | Boyko | |
| 2,735,422 | A | | 2/1956 | Jones | |
| 3,455,295 | A | | 7/1969 | Kellogg | |
| 4,615,335 | A | | 10/1986 | Searcy | |
| 4,638,995 | A | * | 1/1987 | Wilson | 482/142 |
| 4,776,583 | A | | 10/1988 | Jennings | |
| 4,928,673 | A | | 5/1990 | Heneger | |
| 5,033,736 | A | | 7/1991 | Hirschfeld | |
| 5,050,589 | A | * | 9/1991 | Engle | 601/26 |
| 5,071,117 | A | * | 12/1991 | Mautner et al. | 482/57 |
| 5,284,131 | A | * | 2/1994 | Gray | 128/25 |
| 5,938,571 | A | * | 8/1999 | Stevens | 482/96 |
| 5,989,168 | A | * | 11/1999 | See | 482/142 |
| 6,217,486 | B1 | * | 4/2001 | Rosenow | 482/52 |

* cited by examiner

*Primary Examiner*—Jerome Donnelly
(74) *Attorney, Agent, or Firm*—Wendell Coffee

(57) ABSTRACT

A passive exercise device to exercise a person's legs that can be easily moved and efficiently stored in a corner of a room.

20 Claims, 5 Drawing Sheets

EXERCISE DEVICE

CROSS REFERENCE TO RELATED APPLICATION

Applicant filed Provisional Application on this subject matter on Nov. 8, 1999, 60/164,244. Specific reference is made to that document.

BACKGROUND OF THE INVENTION (1) Field of the Invention

This invention relates to a passive exercise device. More specifically, this invention relates to a passive leg exercise device for use by paraplegics or quadriplegics. Physical therapist have ordinary skill in this art.

(2) Description of the Related Art

The related art describes many devices to passively exercise legs. Passive exercise has many beneficial characteristics including increased circulation, better over all muscle tone, and reduced atrophy of the extremities.

For example, GRAY, U.S. Pat. No. 5,284,131, discloses a device for exercising the legs of a person. Using the GRAY device, the person's feet are strapped to what are effectively pedals, and the pedals then are then turned by an electric motor. The turning pedals cause the feet to travel in a circular motion with each foot being 180° out of phase from the other. This circular motion then causes motion of the lower and upper legs to facilitate the passive exercise.

These related art devices generally contain the same functional elements, namely: a frame; motor; crank arms; pedals; and motor control circuitry. This combination of functional parts creates a bulky and somewhat awkward device, especially in the context of storing the device when not in use.

SUMMARY OF THE INVENTION (1) Progressive Contribution to the Art

This invention is a passive exercise device used for exercising a person's impaired lower extremities. Specifically, the device exercises a person's legs by automatically moving the feet in a forward or reverse pedalling motion.

The frame of the device, while providing a structurally sturdy base for the components to perform the automatic pedalling function, also provides an efficient method of moving and storing the exercise unit.

(2) Objects of this Invention

An object of this invention is to provide passive exercise for a person's legs.

Another object of this invention is to provide a stable base upon which dynamic components of the passive exercise device may be placed.

Further objects of this invention are to provide for efficient shipping, moving and storage of the exercise device when not in use.

Further objects are to achieve the above with devices that are sturdy, compact, durable, lightweight, simple, safe, efficient, versatile, ecologically compatible, energy conserving, and reliable, yet inexpensive and easy to manufacture, operate, and maintain.

Other objects are to achieve the above with a method that is rapid, versatile, ecologically compatible, energy conserving, efficient, and inexpensive, and does not require skilled people to install, operate, and maintain.

The specific nature of the invention, as well as other objects, uses, and advantages thereof, will clearly appear from the following description and from the accompanying drawings, the different views of which are not necessarily scale drawings.

CATALOGUE OF ELEMENTS

Figure 3:
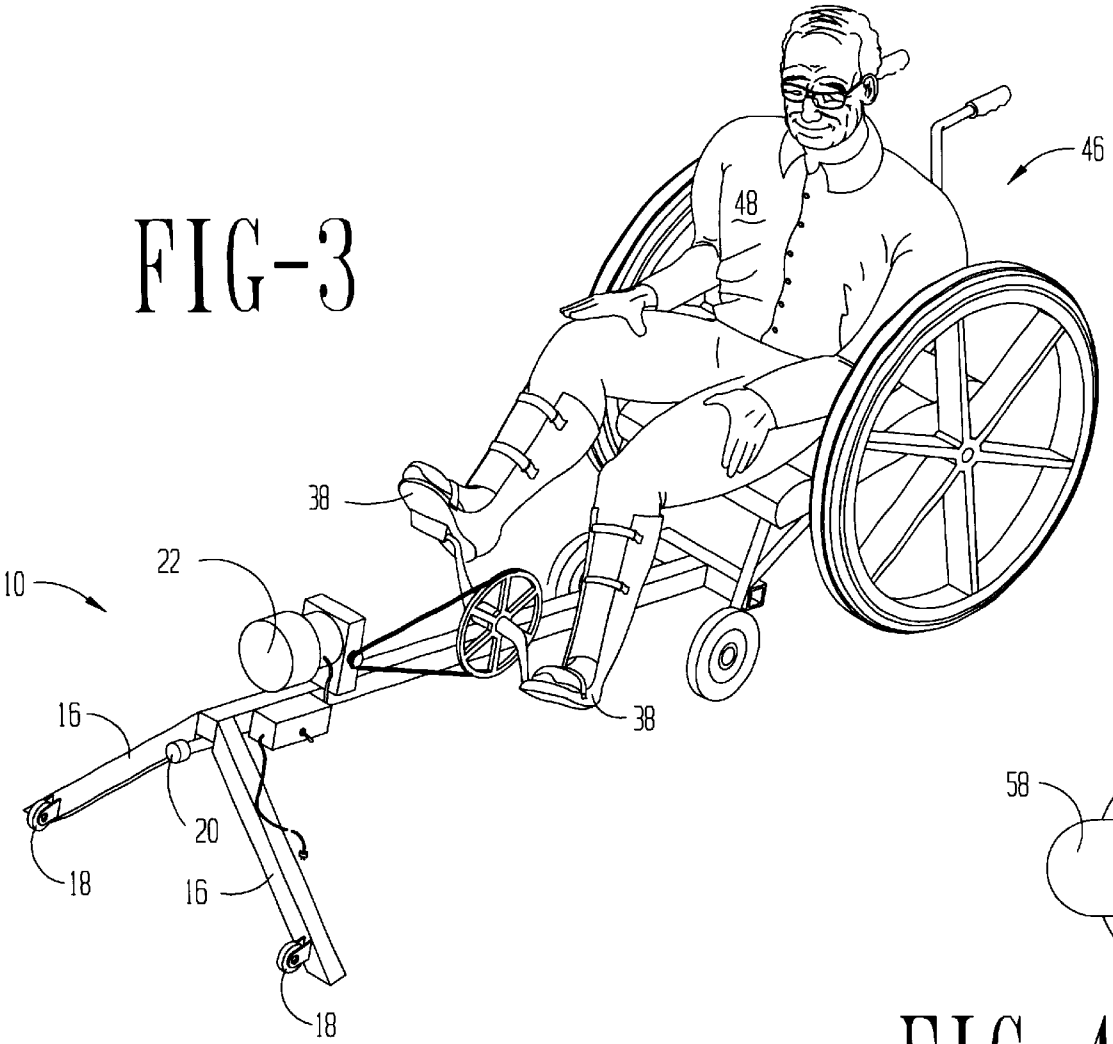
FIG. 3 is a perspective view of the device in use.
Figure 4:
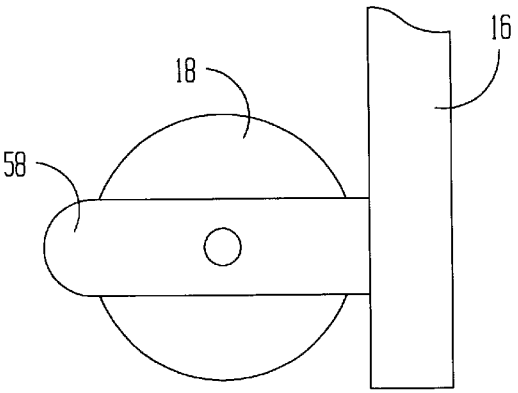
FIG. 4 is an elevational wheel detail.
Figure 5:
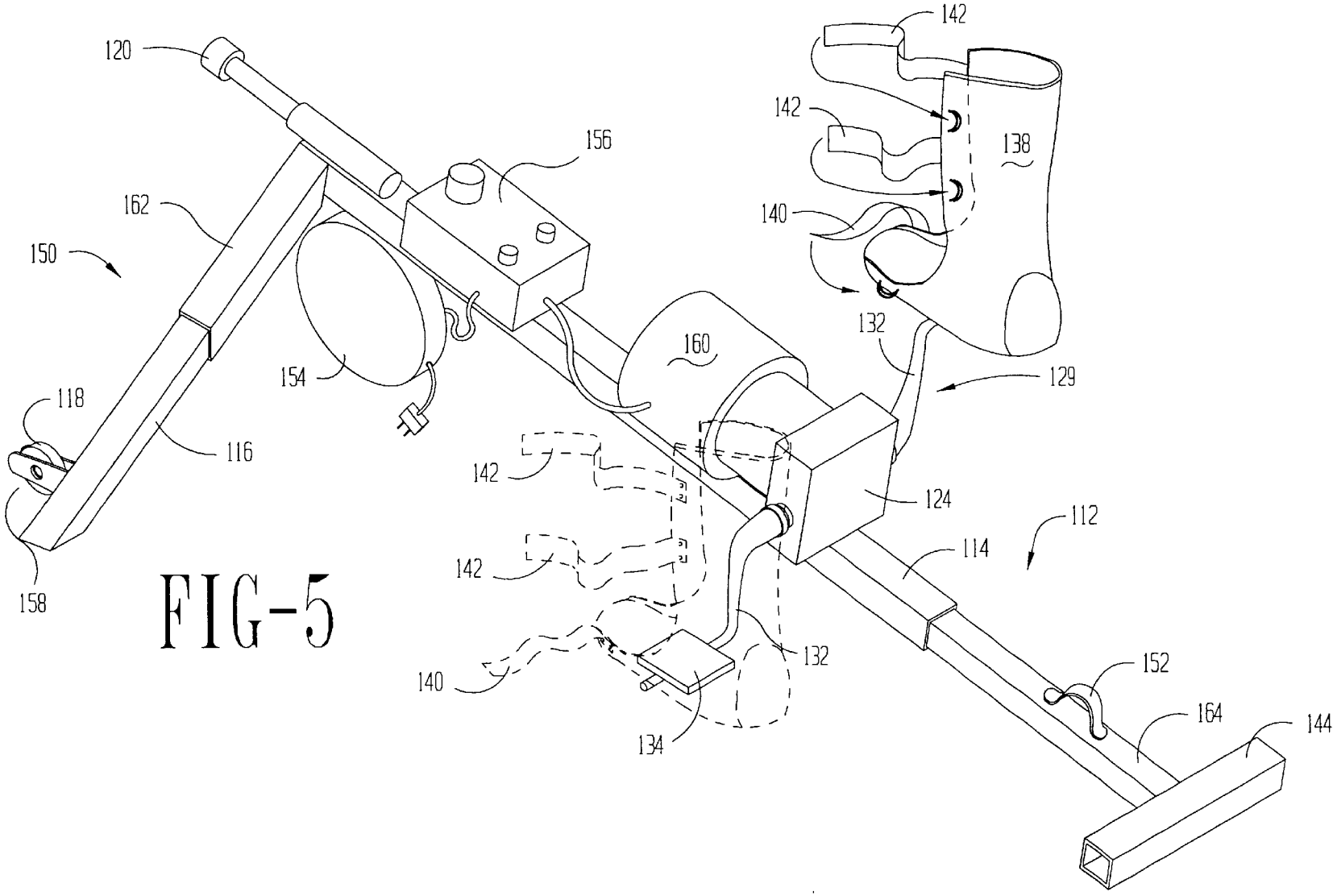
FIG. 5 is a perspective view of the device with an integral pedal assembly with one boot brace removed for clarity.
Figure 6:
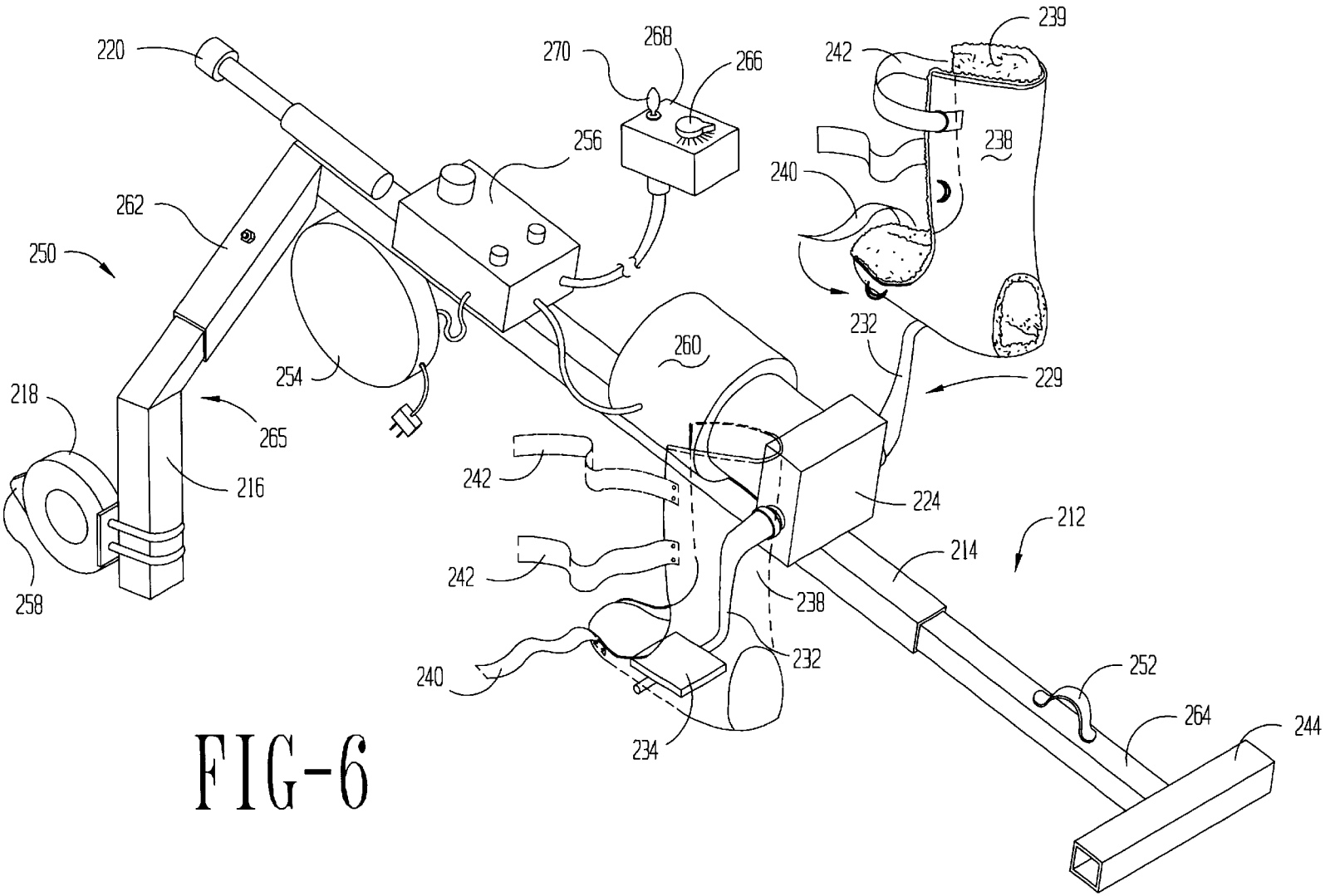
FIG. 6 is a perspective view similar to FIG. 5 with added features.

As an aid to correlating the terms to the exemplary drawings, the following catalog of elements is provided:

| FIGS. 1,2,3,4 | FIG. 5 | FIG. 6 | Item |
|---|---|---|---|
| 10 | 110 | 210 | passive exercise device |
| 12 | 112 | 212 | frame |
| 14 | 114 | 214 | spine |
| 16 | 116 | 216 | leg |
| 18 | 118 | 218 | wheel |
| 20 | 120 | 220 | stand |
| 22 | — | — | motor |
| 23 | 123 | 223 | on-off switch |
| 24 | — | — | gear box |
| 26 | — | — | motor pulley |
| 28 | — | — | belt |
| 29 | 129 | 229 | pedal assembly |
| 30 | — | — | pedal pulley |
| 32 | 132 | 232 | arms |
| 34 | 134 | 234 | pedal |
| 38 | 138 | 238 | boot brace |
| — | — | 239 | boot brace lining |
| 40 | 140 | 240 | foot strap |
| 42 | 142 | 242 | shin strap |
| 44 | 144 | 244 | t-piece |
| 46 | — | — | wheelchair |
| 48 | — | — | chair occupant |
| — | 150 | 250 | retractable legs |
| — | 152 | 252 | handle |
| — | 154 | 254 | cord retractor |
| — | 156 | 256 | timer |
| 58 | 158 | 258 | wheel stand |
| — | 160 | 260 | integral pedal assembly |
| — | 162 | 262 | telescoping leg |
| — | 164 | 264 | telescoping spine |
| α | — | — | angle |
| β | — | — | angle |
| — | — | 265 | leg angle |
| — | — | 266 | speed control |
| — | — | 268 | hand control |
| — | — | 270 | switch arm |

DESCRIPTION OF THE PREFERRED EMBODIMENT

Figure 1:
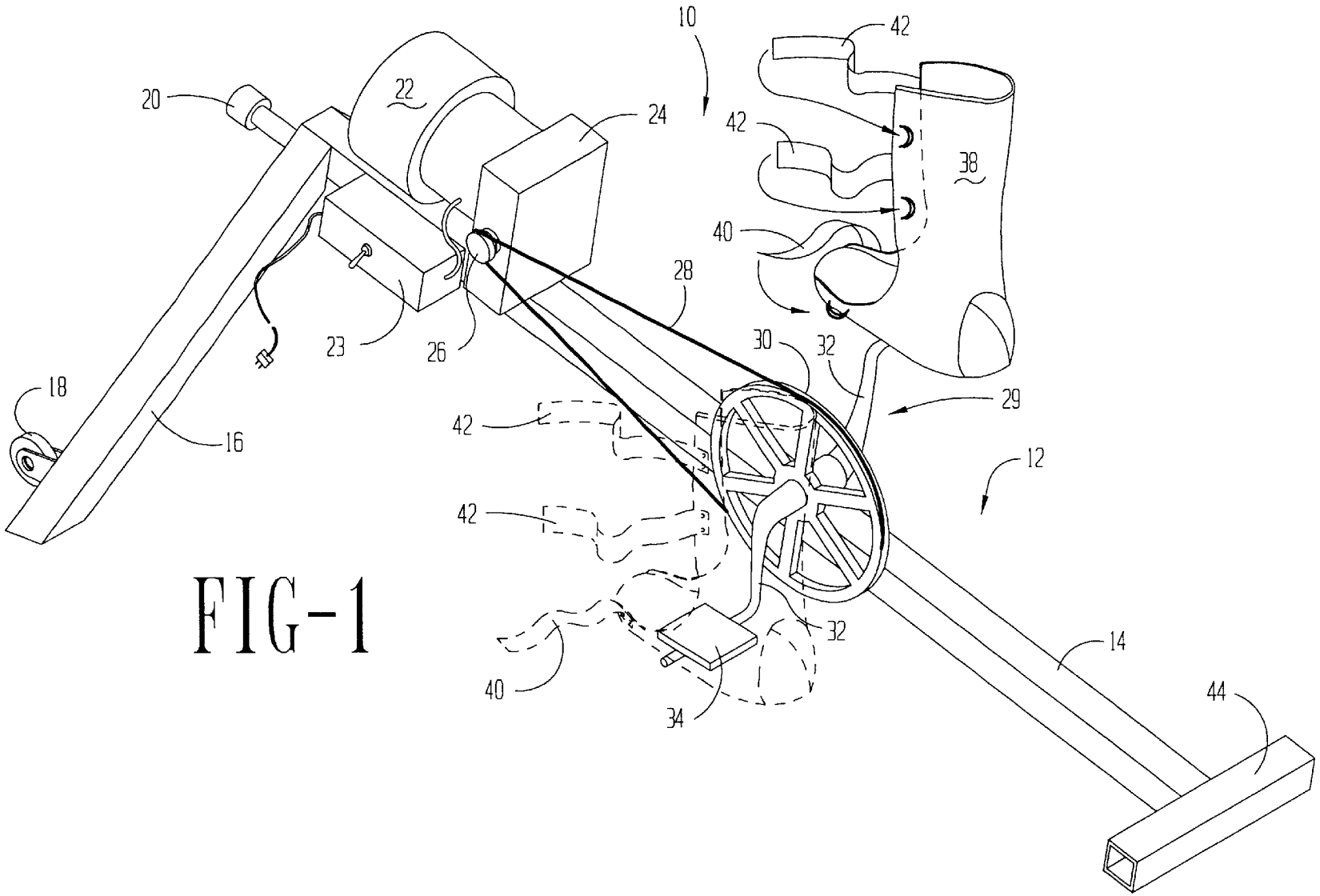
FIG. 1 is a perspective view of the device with one boot brace in phantom for clarity.
Figure 2:
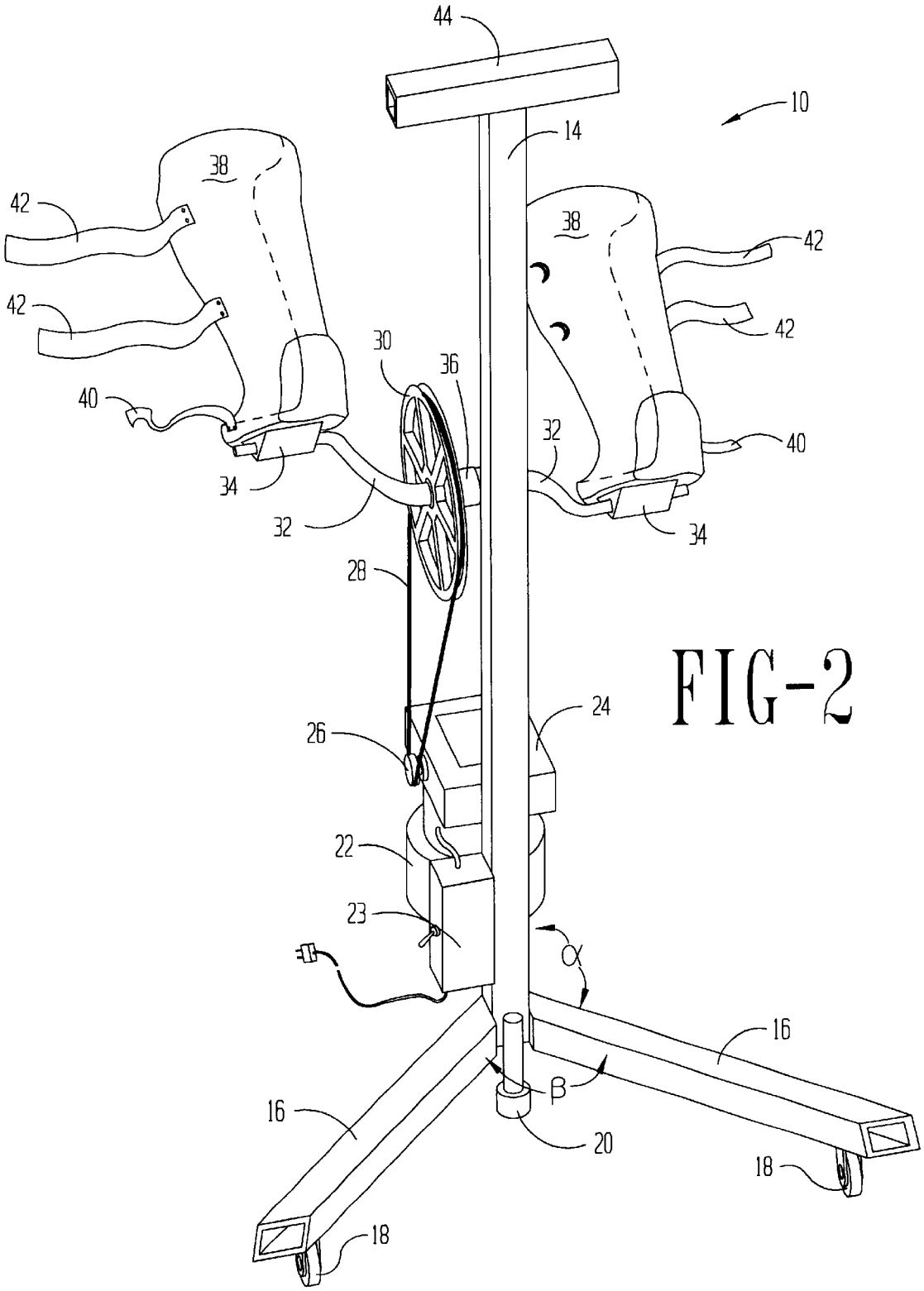
FIG. 2 is a perspective view of the device in the storage position.

Referring to FIGS. 1, 2, and 3 there will be seen a passive exercise device 10. The device comprises a frame 12 being made of a spine 14 and two legs 16. It is contemplated that the spine 14 and legs 16 in this embodiment will be made of square metal tubing; however, any structurally sound product could be used. For example, composite material or metal, circular tubing, pipe, or angle iron could be used. In the embodiment shown, the legs 16 are attached at a right angle, α 90°, (FIG. 2) on an upper end of the spine 14. The angle β between each leg 16, when attached to the spine 14, is preferably between 45° and 90°.

It is however contemplated that the angle α between the spine 14 and the plane of the legs 16 could be greater than 90° or less than 90°, as measured from the direction the legs 16 protrude. There could be various reasons for making this modification to the described angle α including, but not limited to, control of the center gravity of the exercise device such that storage, by standing the device with the spine 14 in a vertical position, could be better controlled.

In a second (FIG. 5) and third (FIG. 6) embodiment. the frame 112 and 212 comprises several additional pieces. Specifically, the spine 114 or 214 has a telescoping spine portion 164 or 264 at a lower end thereof. Additionally, the legs 116 or 216 can be constructed such that they have a extension leg 162 or 262 into which the leg 116 or 216 are telescoped. These changes, as may be seen in FIGS. 5 & 6 accomplish several functions. First, the telescoping spine 164 or 264 aids in collapsing the passive exercise device 110 and 210 for more compact storage. Secondly, the telescoping legs 162 or 262 portions make the passive exercise device adjustable for a more ergonomic adjustment for the chair occupant 48. Also the device may be broken down for shipping in a smaller package.

Also the extension leg 262 is angled at 265 to be substantially vertical. This reduces the width of the device when in use.

With the spine 14, 114 and 214 and the two legs 16, 116 and 216 generally pointing toward the floor the frame 12, 112 and 212 presents itself to be somewhat of a tripod. It is in this tripod-like position that the passive exercise device is used. A motor 22, 122 and 222 is mounted on a middle portion of the spine 14, 114 and 214. Although the motor 22 in the drawings is shown to be mounted on the upper surface of the spine 14, a motor mounted on the lower surface of the spine 14 is within the contemplation of this invention.

The output shaft (not shown) of the motor 22 is connected to a gear box 24. The gear box 24 performs two functions: first to modify the motor output shaft rotational orientation from lying substantially parallel to the spine 14 to being substantially at a 90° to the spine 14; and also to perform a portion of the gearing necessary to control the speed of the pedalling functions. A motor pulley 26 is attached to the output shaft of the gear box 24. The motor pulley 26 transfers rotational energy from the motor 22 to the pedal assembly 29 by means of belt 28. The belt 28 is trained around the pedal pulley 30. Although this embodiment shows a grooved pulley and complementary belt 28, it would be within the contemplation of this invention to use a sprocket and chain to perform the same function. The relative gearing between the motor 22 and the pedal assembly 29 is controlled by gearing of the gear box 24, size of the motor pulley 26, and size of the pedal pulley 30.

The pedal assembly 29 comprises pedal bearings 36, (FIG. 2) pedal pulley 30, two arms 32, 132 and 232 two pedals 34, 134 and 234 and two boot braces 38, 138 and 238. An arm shaft (not identified) extends through the pedal bearings 36. Arms 32, 132 and 232 are attached to each end of that shaft. The arms 32, 132 and 232 are oriented to be 180° apart as attached to the arm shaft. The pedal pulley 30 is rigidly connected to the pedal shaft such that for every complete rotation of the pedal pulley 30 there will be a corresponding complete rotation of each arm 32.

In a second and third embodiment the gear box 124, or 224 motor pulley 26, belt 28, and pedal assembly 129 or 229 are combined into an integral pedal assembly 160 or 260 as shown in FIGS. 5 & 6. More specifically then, the motor connects to the gear box, 124 and 224 an output shaft extends out each side of the gear box, and the pedal assemblies 129 and 229 are connected directly thereto.

A pedal 34, 134 and 234 is on the distal end of each arm. The pedal 34, 134 and 234 performs the same function as that of a pedal on a bicycle; namely, to facilitate placement of the feet.

Since those persons who will use this passive exercise device 10, 134 and 224 will have impaired control of leg movement, there must be some means for securing each foot to its appropriate pedal. This is accomplished in this device by use of a boot brace 38, 138 and 238 attached to each pedal 34, 134 and 234. The boot brace 38, 134 and 234 comprises a lower portion, where the foot will be placed, and an upper portion that would extend up the calf of the chair occupant 48. The boot brace 38, 138 and 238 further comprises a foot strap 40, 140 and 240 to hold the foot against the lower portion of the boot brace 38, 138 and 238 and at least one shin strap 42, 142 and 242 to hold the lower leg against the upper portion of the boot brace 38, 138 and 238. The purpose of the boot brace 38, 138 and 238 is to: 1) ensure the foot stays firmly held against the pedal 34, 134 and 234; and 2) to ensure that the ankle of the chair occupant 48 is not turned during upward movement of the foot. In order to keep the costs of the embodiment shown at a minimum, a standard bicycle pedal is used to fulfill the pedal 34, 134 and 234 requirement. The boot brace 38, 138 and 238 is rigidly attached to the pedal 34, 134 and 234 such as by complementary nuts and bolts (not shown). Although constructed in this manner, it is within the contemplation of this invention that if mass produced the boot brace 38, 138 and 238 and the pedal 34, 134 and 234 could be an integral assembly.

It is desirable that the boot brace 238 have a soft non-abrasive contact with the leg of the user. This is accomplished by lamb fleece covering 239 over the boot brace, particularly the inside portions which contact the user. The covering 238 is attached by Velcro to the boot brace 238 to permit its removal for cleaning and care.

Use of the passive exercise device 10, 110 and 210 then would encompass placing the frame 12, 112 and 212 in the tripod-like position. The chair occupant 48 positions the wheelchair 46 such that the spine 14 extends partially under the wheelchair 46 and between the legs of the chair occupant 48. The legs of the chair occupant 48 then are strapped, by means of the foot strap 40 and shin straps 42, into the boot brace 38. Once the wheelchair 46 is in position and the legs are securely strapped in the boot braces 38, the motor 22 is started which causes a corresponding rotational movement of the pedals 34 which facilitates the exercise of the chair occupant's 48 legs.

The motor 22 may turn in either a forward or reverse direction, which would create the possibility of forward pedalling and reverse pedalling. Further, motor speed is adjustable by control 266. In the embodiment shown, the motor 22 is a 120 volt AC, 60 Hz, ½ horsepower reversible motor. This horsepower rating of the motor was sufficient to adequately exercise the legs of the chair occupant 48 without unduly loading the motor.

FIG. 1 shows an embodiment of the invention with merely a motor on-off switch 23 for on, off, and directional control of the motor. FIG. 5 shows an embodiment of this invention where the motor on-off switch is replaced with a timer 156. The timer 156 and the motor on-off switch are combined in this figure to show that it is within the contemplation of this invention that exercise times could be controlled by, and automatically stopped by the timer 156. Also shown in FIGS. 5 & 6 is a second embodiment having the addition of a cord retractor 154 or 254. As the name implies, the cord retractor retracts the cord into a spool for storage when not in use.

Also FIG. 6 includes a hand held control box 268 which has an emergency off switch arm 270 as well as the speed control 266. The switch arm 270 permits forward, reverse or stop motion.

On the distal end of each leg 16, 116 and 216 there exists a wheel 18, 118 and 218. The wheel 18, 118 and 218 on each leg 16, 116 and 216 is designed and placed so that when the frame 12, 112 and 212 is in the tripod-like position, the wheel 18, 118 and 218 does not contact the floor. However, as the spine 14, 114 and 214 is raised to be approximately in a horizontal position, the wheel 18, 118 and 218 of each leg 16, 116 and 216 contacts the floor. By grabbing the spine 14, 114 and 214 at its lower end, or by handle 152, or 252 and raising the spine 14,114 and 214 upwards to be approximately horizontal, the wheels 18, 118 and 218 contact the floor which therefore facilitates easy movement of the passive exercise device 10, 110 and 210 from location to location. Moving the passive exercise device 10, 110 and 210 from a location where it has been used to a storage location in a corner of a room would then comprise picking up the lower end of the spine 14, 114 and 214 to an orientation where the wheels 18, 118 and 218 on the distal end of each leg 16, 116 and 216 contacts the floor. The passive exercise device 10, 110 and 210 may be stored in a corner of a room by rolling the device 10, 110 and 210 on the wheels 18, 118 and 218 close to the corner and then rotating the spine 14, 114 and 214 to be substantially vertical. That is, the upper end of the spine 14, 114 and 214 and the legs 16, 116 and 216 would be placed substantially at the intersection of the three planes of two walls and a floor. It will be understood that the intersection of two walls form a corner and when the device is in the corner the legs extend a long the walls. To further facilitate standing the passive exercise device 10 in a corner, there exists a stand 20, 120 and 220 that is attached at the upper end of the spine 14, 114 and 214 and the wheels 18, 118 and 218. The purpose of the stand 20, 120 and 220 is to hold the plane created by the legs 16, 116 and 216 substantially parallel to the floor when the spine 14 is in the storage vertical position.

As seen in FIG. 6, it is desirable that the diameter of the wheels 218 be approximately the throw of arm 232. That is the diameter approximately equals the distance of the pedal axis to the pedal 234. This results in easier rolling than smaller wheels.

FIG. 4 shows a detail of a distal of a leg 16 including a wheel 18 and wheel stand 58. As shown in the figure, the wheel stand 58 has a length longer than the diameter of the wheel 18. The purpose for this is to have the wheel stand 58 support the weight of the exercise 10 when the spine 14 is in the vertical position. Additionally, and as may be seen in FIG. 5, the stand 120 can be made to be telescopic to again assist in making the exercise device 110 more compact for long term storage.

This specification indicates placement of various components of the device as being on a lower, middle, or upper portion of some element. Since this device has two desired stable positions, it will be understood that a reference to a lower, middle, or upper portion of any component is referenced to the position of that component when the spine 14, 114 and 214 is in the tripod position. Further, references are made to inner and outer surfaces of various components. The outer surface of any particular component of this device is that surface that faces outward from the device when the frame 12, 112 and 212 is in the tripod-like position. The inner surface is any portion of the device that faces the ground when the frame 12, 112 and 212 is in the tripod-like position.

Although not shown in the drawings or referenced in the specification, it would be desirable to have some kind of chain or belt guard covering the pedal pulley 30. The obvious reasons to have this chain or pulley guard is to keep fingers, toes, and articles of clothing from becoming entangled between the belt or chain and the complementary pulleys.

The device as shown in the drawings would be suitable for operation on a carpeted surface; however, as shown the device would not be suitable for use on a tile or otherwise slick surface. To remedy this problem it is within the contemplation of this invention that rubber coatings or rubber surfaces could be attached to the distal ends of the legs 16, 116 and 216 and on the T-piece 44, 144 and 244 to keep the device from sliding on the floor when in use. FIGS. 1 and 2 prominently show the T-piece 44. In addition to being in a location where a rubber foot or rubber surface could be placed on an inner surface thereof, the T-piece 44 too could be used as a handle in the transportation of the device from a storage location.

It will be understood that any element in FIG. 5 or FIG. 6 not specifically identified is substantially the same element in FIGS. 1–4 having the same last two numbers.

By the above specifications and drawings, one with ordinary skill in the art will understand how to make and use the invention as described. At this time the description above includes the best mode known to the inventor of carrying out his invention.

The embodiment shown and described above is only exemplary. I do not claim to have invented all the parts, elements or steps described. Various modifications can be made in the construction, material, arrangement, and operation, and still be within the scope of my invention.

The restrictive description and drawings of the specific examples above do not point out what an infringement of this patent would be, but are to point out the advantages and the progressive contribution to the physical therapy arts and to enable one skilled in the art to make and use the invention. The limits of the invention and the bounds of the patent protection are measured by and defined in the following claims.

What is claimed is:

1. An exercise device comprising:

a) a spine having a spine upper end and a spine lower end, b) two legs each attached at a leg upper end to the spine near the spine upper end to elevate the upper end, c) two wheels, on of the wheels attached to each leg on a side away from the spine lower end near a lower end of each leg, d) a wheel stand which is longer than the diameter of the wheel attached to each leg adjacent the wheel extending from the leg a greater distance than any point of the wheel, e) an electric motor mounted on an upper side of the spine, f) an axle journalled to the spline at a right angle to the spine, g) a crank with a pedal attached to the axle at each end of the axle, and h) the axle drivingly connected to the motor providing means for rotating the axle.

2. The invention as defined in claim 1 further comprising:

j) a handle on the spine near the spine lower end.

3. The invention as defined in claim 1 further comprising:

j) a spine stand attached to the spine upper end constructed and arranged so that the device can be oriented to stand on the spine stand and each wheel stand in a corner with each leg extending along a wall forming said corner.

4. The invention as defined in claim 1 further comprising:

j) two leg extensions attached to the spine, k) each leg extension being constructed of square tubing and having one of the legs telescoped therein, thereby attaching each leg as stated.

5. The invention as defined in claim 4 further comprising:

l) each of said legs angled at a segment having the wheel attached, and m) the segments with the wheel attached are parallel.

6. The invention as defined in claim 4 further comprising:

l) said spine constructed of square tubing, m) a spine extension telescoped into the spine lower end, n) a T-piece on an end of the spine extension, and o) a handle on the spine extension.

7. The invention as defined in claim 6 further comprising:

p) each of said legs angled at a segment having the wheel attached, and q) the segments with the wheel attached are parallel.

8. The invention as defined in claim 1 further comprising:

j) an electric cord retractor attached to the spine, k) an electric cord with a plug extending from the retractor, and l) a circuit electrically connecting the retractor to the motor.

9. The invention as defined in claim 8 further comprising:

m) the circuit having a timer means for opening the circuit at a preset time expiration.

10. The invention as defined in claim 8 further comprising:

m) the circuit having a speed means for electrically controlling the speed of the motor.

11. The invention as defined in claim 8 further comprising:

m) a manual switch means for opening and closing the circuit.

12. The invention as defined in 8 further comprising:

m) a reverse switch means for reversing the rotation of the axle.

13. The invention as defined in claim 12 further comprising:

n) the circuit having a timer means for opening the circuit at a preset time expiration, o) the circuit having a speed means for electrically controlling the speed of the motor, and p) a manual switch means for opening and closing the circuit.

14. The invention as defined in claim 1 further comprising:

j) each pedal having a foot portion of a boot brace attached thereto, and k) a foot strap connected to the foot portion adapted to strap a foot to the foot portion.

15. The invention as defined in claim 14 further comprising:

l) an upper portion of the boot brace connected to the foot portion with m) a shin strap connected to the upper portion adapted to strap a calf of a leg to the upper portion.

16. The invention as defined in claim 15 further comprising:

n) lamb fleece covering the inside portion of the boot brace.

17. An exercise device comprising:

a) a spine having a spine upper end and a spine lower end, b) two legs each attached at a leg upper end to the spine near the spine upper end to elevate the upper end, c) two wheels, on of the wheels attached to each leg on a side away from the spine lower end near a lower end of each leg, d) a wheel stand which is longer than the diameter of the wheel attached to each leg adjacent the wheel extending from the leg a greater distance than any point of the wheel, e) an electric motor mounted on an upper side of the spine, f) an axle journalled to the spline at a right angle to the spine, g) a crank with a pedal attached to the axle at each end of the axle, h) the axle drivingly connected to the motor providing means for rotating the axle, j) a spine stand attached to the spine upper end constructed and arranged so that the device can be oriented to stand on the spine stand and each wheel stand in a corner with each leg extending along a wall forming said corner, k) an electric cord retractor attached to the spine, l) an electric cord with a plug extending from the retractor, m) a circuit electrically connecting the retractor to the motor, n) the circuit having a reverse switch means for reversing the rotation of the axle, o) the circuit having a timer means for opening the circuit at a preset time expiration, p) the circuit having a speed means for electrically controlling the speed of the motor, and q) a manual switch means for opening and closing the circuit.

18. An exercise device comprising:

a) a spine having a spine upper end and a spine lower end, b) two legs each attached at a leg upper end to the spine near the spine upper end to elevate the upper end, c) two wheels, on of the wheels attached to each leg on a side away from the spine lower end near a lower end of each leg, d) a wheel stand which is longer than the diameter of the wheel attached to each leg adjacent the wheel extending from the leg a greater distance than any point of the wheel, e) an electric motor mounted on an upper side of the spine, f) an axle journalled to the spline at a right angle to the spine, g) a crank with a pedal attached to the axle at each end of the axle, h) the axle drivingly connected to the motor providing means for rotating the axle, j) a spine stand attached to the spine upper end constructed and arranged so the the device can be oriented to stand on the spine stand and each wheel stand in a corner with each leg extending along a wall forming said corner, k) two leg extensions attached to the spine, l) each leg extension being constructed of square tubing and having one of the legs telescoped therin, thereby attaching each leg as stated, m) each of said legs angled at a segment having the wheel attached, n) the segments with the wheel attached are parallel, o) said spine constructed of square tubing, p) a spine extension telescoped into the spine lower end, q) a T-piece on an end of the spine extension, r) a handle on the spine extension, s) each pedal having a foot portion of a boot brace attached thereto, t) a foot strap connected to the foot portion adapted to strap a foot to the foot portion, and u) an upper portion of the boot brace connected to the foot portion with v) a shin strap connected to the upper portion adapted to strap a calf of a leg to the upper portion, and w) lamb fleece covering the inside portion of the boot brace.

19. The invention as defined in claim 18 further comprising:

x) said lamb fleece held in place with velcro.

20. The invention as defined in claim 18 further comprising:

x) an electric cord retractor attached to the spine, y) an electric cord with a plug extending from the retractor, z) a circuit electrically connecting the retractor to the motor, aa) the circuit having a reverse switch means for reversing the rotation of the axle, bb) the circuit having a timer means for opening the circuit at a preset time expiration, cc) the circuit having a speed means for electrically controlling the speed of the motor, and dd) a manual switch means for opening and closing the circuit.

* * * * *